US006289901B1

(12) United States Patent
Singer et al.

(10) Patent No.: US 6,289,901 B1
(45) Date of Patent: Sep. 18, 2001

(54) NAIL INSTRUMENT WITH EMERY CONE AND BLADE IMPLEMENTS AT OPPOSITE ENDS

(76) Inventors: Richard A. Singer; Ronda Anderson Singer, both of 5352 Renaissance Ave., San Diego, CA (US) 92122

( * ) Notice: Subject to any disclaimer, the term of this patent is extended or adjusted under 35 U.S.C. 154(b) by 0 days.

(21) Appl. No.: 09/520,073

(22) Filed: Mar. 7, 2000

Related U.S. Application Data

(60) Provisional application No. 60/125,287, filed on Mar. 19, 1999.

(51) Int. Cl.[7] ..... A45D 29/18; A45D 29/04

(52) U.S. Cl. ..... 132/76.4; 132/75.6; 132/73.5

(58) Field of Search ..... 132/76.4, 73, 73.5, 132/75.6; 51/392

(56) References Cited

U.S. PATENT DOCUMENTS

| | | | | |
|---|---|---|---|---|
| D. 116,216 | * | 8/1939 | Brekke | 132/76.4 |
| D. 141,265 | * | 5/1945 | Miller | 132/76.4 |
| D. 148,487 | * | 1/1948 | Scoulous | 132/76.4 |
| 448,409 | * | 3/1891 | Cassidy | 132/76.4 |
| 1,040,466 | | 10/1912 | Smith . | |
| 1,629,967 | * | 5/1927 | Rex | 132/76.4 |
| 1,837,849 | | 12/1931 | Bruninghaus . | |
| 1,956,627 | | 5/1934 | Roth | 132/73 |
| 2,035,323 | | 3/1936 | Langdon | 132/73 |
| 2,472,667 | * | 6/1949 | Lessard | 132/76.4 |
| 4,559,957 | | 12/1985 | Hokama | 132/73 |
| 5,195,278 | * | 3/1993 | Grove | 51/392 |
| 5,439,013 | | 8/1995 | Hoover | 132/76.5 |
| 5,996,590 | * | 12/1999 | Steege | 132/76.4 |
| 6,102,048 | * | 8/2000 | Baker | 132/76.4 |

FOREIGN PATENT DOCUMENTS

| | | | |
|---|---|---|---|
| 475452 | 7/1951 | (CA) | 132/75.6 |
| 620936 | 5/1937 | (FR) | 132/75.6 |
| 52887 | 6/1945 | (FR) | 132/73 |

* cited by examiner

*Primary Examiner*—John J. Wilson
*Assistant Examiner*—Robyn Kieu Doan
(74) *Attorney, Agent, or Firm*—Flanagan & Flanagan; John R. Flanagan; John K. Flanagan

(57) ABSTRACT

A nail instrument includes an elongated handle, a first implement and a second implement. The elongated handle has opposite end portions. Each of the first and second implements have a connecting portion and a working portion. The connecting portion of the first implement is removably mounted to one of the opposite end portions of the elongated handle. The working portion of the first implement is in the form of a conical structure substantially comprised of emery material for providing a filing action. The connecting portion of the second implement is removably mounted to the other of the opposite end portions of the elongated handle. The working portion of the second implement is in the form of a sleeve merging into a flattened blade for providing a prying action and a scraping action.

8 Claims, 2 Drawing Sheets

NAIL INSTRUMENT WITH EMERY CONE AND BLADE IMPLEMENTS AT OPPOSITE ENDS

This application claims the benefit of provisional application No. 60/125,287 filed Mar. 19, 1999.

BACKGROUND OF THE INVENTION

1. Field of the Invention

The present invention generally relates to manicure devices and, more particularly, is concerned with a nail instrument, for use on fingers and toes and in other applications, having emery cone and blade implements at opposite ends of the instrument.

2. Description of the Prior Art

People who have artificial nails on fingers and toes often end up with substances, such as glue and the like, which are used therewith on the undersides of the artificial nails. These substances trap dirt and other foreign material and often cannot be removed by washing or by use of a nail brush alone. Any buildup of such substances should be removed for both cosmetic and hygienic reasons. Care must be taken in the removal of the substances because the natural nails of the fingers and toes are exposed under the artificial nails.

Current methods for cleaning the undersides of and smoothing nails include the use of a drill or a tool for scraping the undersides. Problems exist, however, with these methods. The drill is noisy, cumbersome, creates an uncomfortable feeling and an odd smell, may be ineffective and may cause damage to the natural nails. Other scraping tools may have similar problems associated with them.

A variety of manicure devices which employ scraping actions and the like have been developed over the years. Representative examples of these manicure devices are disclosed in U.S. Pat. No. 1,040,446 to Smith, U.S. Pat. No. 1,629,967 to Rex, U.S. Pat. No. 1,837,849 to Bruninghaus, U.S. Pat. No. 1,956,627 to Roth, U.S. Pat. No. 2,035,323 to Langdon, U.S. Pat. No. 4,559,957 to Hokama, U.S. Pat. No. 5,439,013 to Hoover, Canadian Pat. No. 475,452 to Miller, French Pat. No. 52,887 to Walter-Martin and French Pat. No. 620,936 to Beck. These prior art manicure devices generally disclose an elongated handle and implements which are adapted to fit at one or both opposite ends of the handle. While these prior art devices appear to provide satisfactory solutions for the specific needs for which they are designed, none of them seem to provide an optimum solution for cleaning the undersides of and smoothing nails.

Consequently, a need still exists for a nail instrument which includes specific implements that provide a more effective solution for the aforementioned problem in the prior art without introducing any new problems in place thereof.

SUMMARY OF THE INVENTION

The present invention provides a nail instrument designed to satisfy the aforementioned need. The nail instrument of the present invention includes an elongated handle and a pair of implements which are adapted to fit at opposite ends of the handle. The handle of the nail instrument can be manipulated such that the implements thereon provide a filing action, a prying action and a scraping action. The implements of the nail instrument provide an optimum solution for cleaning the undersides of and smoothing nails. The implements of the nail instrument are also useful in other applications, such as in medical, arts and crafts, and automotive fields.

Accordingly, the present invention is directed to a nail instrument which comprises: (a) an elongated handle having opposite end portions; and (b) an implement having a connecting portion and a working portion, the connecting portion being removably mounted to one of the opposite end portions of the elongated handle, the working portion being in the form of a conical structure substantially comprised of emery material for providing a filing action.

More particularly, the elongated handle has a generally cylindrical configuration. The one opposite end portion of the elongated handle is internally threaded and the connecting portion of the implement is externally threaded and threadably interfittable with the internally threaded one opposite end portion of the elongated handle for securing the implement to the one opposite end portion of the elongated handle. As an alternative, the one opposite end portion of the elongated handle can be externally threaded and the connecting portion of the implement internally threaded to threadably interfit with the externally threaded one opposite end portion of the elongated handle and thereby secure the implement to the one opposite end portion of the elongated handle. The elongated handle has an external surface with a gripping means defined thereon and disposed adjacent to the one opposite end portion of the elongated handle. The working portion of the implement is removably mounted on the connecting portion of the implement such that the working portion of the implement is disposable and replaceable.

The present invention is also directed to a nail instrument which comprises: (a) an elongated handle having opposite end portions; and (b) an implement having a connecting portion and a working portion, the connecting portion being removably mounted to one of the opposite end portions of the elongated handle, the working portion being in the form of a sleeve merging into a flattened blade for providing a prying action and a scraping action.

The present invention is also directed to a nail instrument which comprises: (a) an elongated handle having opposite end portions; (b) a first implement having a connecting portion and a working portion, the connecting portion of the first implement being removably mounted to one of the opposite end portions of the elongated handle, the working portion of the first implement being in the form of a conical structure substantially comprised of emery material for providing a filing action; and (c) a second implement having a connecting portion and a working portion, the connecting portion of the second implement being removably mounted to the other of the opposite end portions of the elongated handle, the working portion of the second implement being in the form of a sleeve merging into a flattened blade for providing a prying action and a scraping action.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
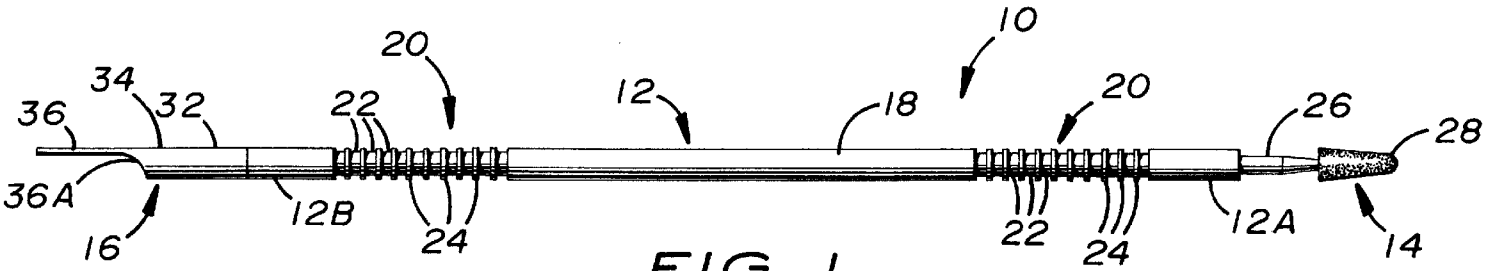
FIG. 1 is a side elevational view of a nail instrument of the present invention showing an elongated handle and first and second implements of the nail instrument.

Referring to the drawings and particularly to FIG. 1, there is illustrated a nail instrument, generally designated 10, of the present invention. The nail instrument 10 basically includes an elongated handle 12 and first and second implements 14, 16 respectively mounted to opposite end portions 12A, 12B of the handle 12.

Figure 2:
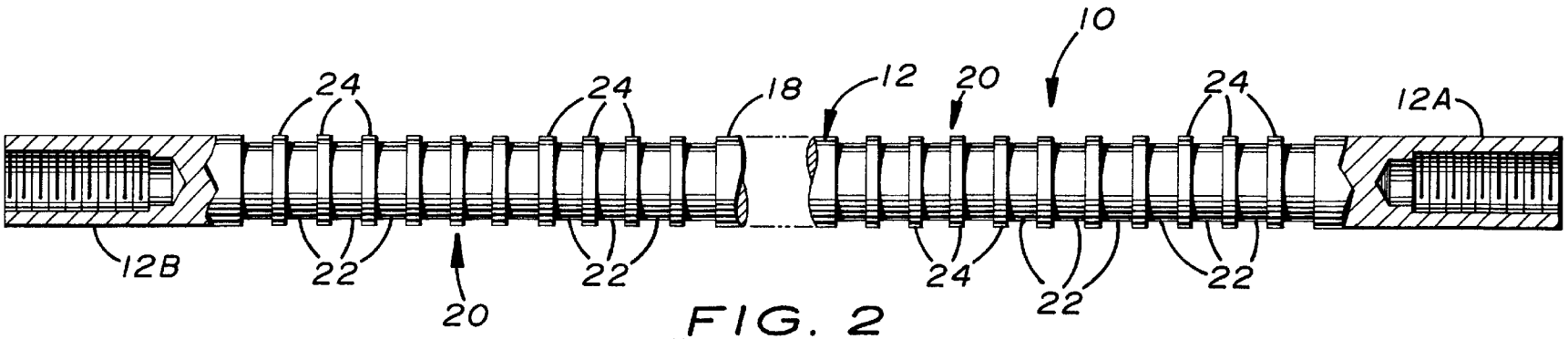
FIG. 2 is a side elevational view of the elongated handle of the nail instrument with the first and second implements removed therefrom.
Figure 5:
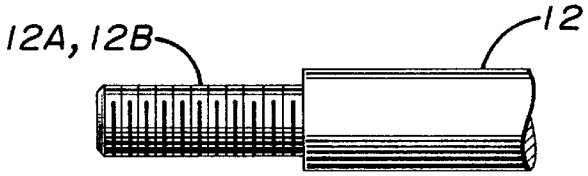
FIG. 5 is an enlarged fragmentary side elevational view of an alternative embodiment of an opposite end portion of the elongated handle of the nail instrument showing the opposite end portion being externally threaded rather than internally threaded as shown in FIG. 2.

Referring now to FIGS. 1 and 2, the elongated handle 12 has a substantially cylindrical configuration and any suitable longitudinal length and a diameter which can be substantially uniform along and substantially less than the longitudinal length. The handle 12 can be provided in different sizes, including different lengths and/or diameters. The handle 12 has two embodiments. In one embodiment of the elongated handle 12, at least one and, preferably, both of the opposite end portions 12A, 12B are hollow and internally threaded, as shown in FIGS. 1 and 2. In this embodiment, each opposite end portion 12A, 12B has a diameter which is substantially the same as the diameter of the rest of the handle 12. In another embodiment of the handle 12, at least one and, preferably, both of the opposite end portions 12A, 12B are solid and externally threaded, as shown in FIG. 5. In this embodiment, each opposite end portion 12A, 12B has a diameter which is less than the diameter of the rest of the handle 12. The opposite end portions 12A, 12B of the handle 12 may be of the same embodiment and may be substantially identical to one another or may be of different embodiments. Each of the opposite end portions 12A, 12B of the handle 12 has a length which is substantially less than the longitudinal length of the portion of the handle 12 extending between the opposite end portions 12A, 12B such that the opposite end portions 12A, 12B of the handle 12 represent relatively small portions thereof.

The handle 12 further has an external surface 18 with gripping means 20 defined thereon. The gripping means 20 may be disposed at one location or at a pair of spaced apart locations. The gripping means 20 may, particularly, be disposed adjacent to one or both of the opposite end portions 12A, 12B of the handle 12. The gripping means 20 at the one or both locations is in the form of alternating grooves 22 and lands 24. The gripping means 20, particularly, has eleven grooves 22 and ten lands 24 at each location, though any other suitable number of grooves 22 and lands 24 could be provided at each location. Each of the grooves 22 and the lands 24 has a diameter such that the diameter of each land 24 is greater than the diameter of each groove 22. Each of the grooves 22 and the lands 24 has a longitudinal length which extends substantially parallel to the longitudinal length of the handle 12 such that the longitudinal length of each land 24 is less than the longitudinal length of each groove 22. Each groove 22 has a depth in relation to adjacent lands 24. The depths of the grooves 22 gradually increase from the groove 22 which is disposed closer to the adjacent one of the opposite end portions 12A, 12B of the handle 12 to the groove 22 which is disposed farther from the adjacent one opposite end portion 12A, 12B of the handle 12 at each location. The grooves 22 and the lands 24 may also have any other suitable shape and size in relation to one another. Alternatively, the gripping means 20 can be knurled areas on the external surface 18 of the handle 12 adjacent to the opposite end portions 12A, 12B thereof.

Figure 3:
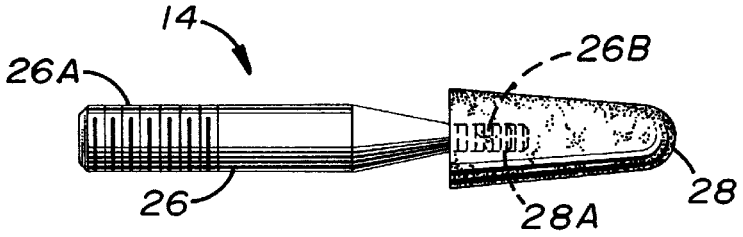
FIG. 3 is an enlarged side elevational view of the first implement of the nail instrument of FIG. 1.
Figure 4:
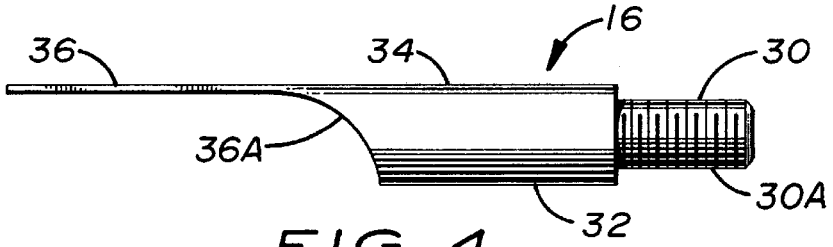
FIG. 4 is an enlarged side elevational view of the second implement of the nail instrument of FIG. 2.
Figure 6:
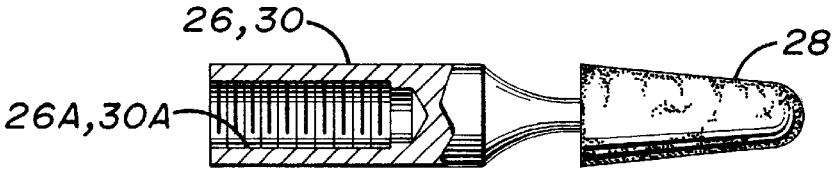
FIG. 6 is an enlarged fragmentary side elevational view of an alternative embodiment of a connecting portion of each of the first and second implements of the nail instrument being internally threaded rather than externally threaded as shown in FIGS. 3 and 4.

Referring now to FIGS. 1, 3 and 6, the first implement 14 has a connecting portion 26 and a working portion 28. The connecting portion 26 is removably mounted to the opposite end portion 12A of the handle 12. The connecting portion 26 has a substantially cylindrical configuration and is also pointed at an end thereof where the connecting portion 26 meets the working portion 28, though the configuration of the connecting portion 26 need not be so limited. The connecting portion 26 has two embodiments. In one embodiment, the connecting portion 26 is solid and externally threaded at 26A, as shown in FIG. 3. In this embodiment, the connecting portion 26 has a diameter which is less than the diameter of the opposite end portion 12A of the handle 12. In another embodiment, the connecting portion 26 is hollow and internally threaded at 26A, as shown in FIG. 6. In this embodiment, the connecting portion 26 has a diameter which is greater than the diameter of the opposite end portion 12A of the handle 12. In both embodiments, the connecting portion 26 is threadably interfittable with the internally or externally threaded opposite end portion 12A of the handle 12 to secure the first implement 14 to the opposite end portion 12A of the handle 12. Connection of the first implement 14 to the opposite end portion 12A of the handle 12 may also be achieved by any other suitable means. The working portion 28 is in the form of a conical structure substantially comprised of emery material for providing a filing action. The working portion 28 can be internally threaded at 28A so as to be threadably mounted on an externally threaded end 26B of the the connecting portion 26, as seen in FIG. 3, such that the working portion 28 is replaceable. The working portion 28 is, particularly, removably mounted on the connecting portion 26 in any suitable manner such that an apex of the conical structure is pointed away from the connecting portion 26. The working portion 28 is, particularly, suited for filing nails (not shown), such as fingernails or toenails, and may also be used for extracting foreign material from an underside of a nail and in other applications.

Figure 7:
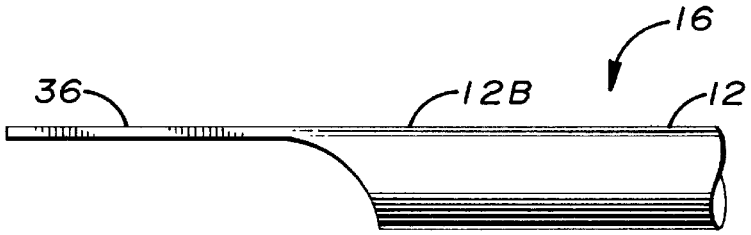
FIG. 7 is an enlarged side elevational view of an alternative embodiment of the second implement of the nail instrument being integrally formed on an opposite end portion of the elongated handle of the nail instrument.

Referring now to FIGS. 1, 4, 6 and 7, the second implement 16 has a connecting portion 30 and a working portion 32. The connecting portion 30 has a substantially cylindrical configuration and is removably mounted to the opposite end portion 12B of the handle 12. The connecting portion 30 has two embodiments. In one embodiment, the connecting portion 30 is solid and externally threaded at 30A, as shown in FIG. 3. In this embodiment, the connecting portion 30 has a diameter which is less than the diameter of the opposite end portion 12B of the handle 12. In another embodiment, the connecting portion 30 is hollow and internally threaded at 30A, as shown in FIG. 6. In this embodiment, the connecting portion 30 has a diameter which is greater than the diameter of the opposite end portion 12B of the handle 12. In both embodiments, the connecting portion 30 is threadably interfittable with the internally or externally threaded opposite end portion 12B of the handle 12 to secure the second implement 16 to the opposite end portion 12B of the handle 12. Connection of the second implement 16 to the opposite end portion 12B of the handle 12 may also be achieved by any other suitable means. The working portion 32 is in the form of a sleeve 34 merging into a flattened blade 36 for providing a prying action and a scraping action. The sleeve 34 is substantially hollow and has a substantially cylindrical configuration. The sleeve 34 is integrally formed with the connecting portion 30 and is open in the direction of the blade 36. The blade 36 is of a substantially flat and narrow longitudinal configuration and has opposite longitudinal edges 36A. The longitudinal edges 36A of the blade 36 rise such that the blade 36 has a slightly curved transverse configuration. The sleeve 34 merges into the blade 36. The blade 36 is particularly adapted for pushing back a cuticle at a base of a nail, though may have any other suitable function. Alternatively, the second implement 16 can be non-removably and integrally formed on the opposite end portion 12B of the handle 12, as seen in FIG. 7.

Other implements may also be employed with the elongated handle 12. The nail instrument 10 has the potential for multiple uses, such as in the medical field, arts and crafts and automotive industries.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A nail instrument, comprising:

(a) an elongated handle having opposite end portions;

(b) a first implement having a connecting portion and a working portion, said connecting portion of said first implement being removably mounted to one of said opposite end portions of said elongated handle, said working portion of said first implement being in the form of a conical structure substantially comprised of emery material for providing a filing action; and (c) a second implement having a connecting portion and a working portion, said connecting portion of said second implement being removably mounted to the other of said opposite end portions of said elongated handle, said working portion of said second implement being in the form of a sleeve merging into a flattened blade for providing a prying action and a scraping action.

2. The instrument of claim 1 wherein said elongated handle has a substantially cylindrical configuration.

3. The instrument of claim 1 wherein:

said one opposite end portion of said elongated handle is internally threaded; and said connecting portion of said first implement is externally threaded and threadably interfittable with the internally threaded said one opposite end portion of said elongated handle for securing said first implement to said one opposite end portion of said elongated handle.

4. The instrument of claim 1 wherein:

said one opposite end portion of said elongated handle is externally threaded; and said connecting portion of said first implement is internally threaded and threadably interfittable with the externally threaded said one opposite end portion of said elongated handle for securing said first implement to said one opposite end portion of said elongated handle.

5. The instrument of claim wherein:

said other opposite end portion of said elongated handle is internally threaded; and said connecting portion of said second implement is externally threaded and threadably interfittable with the internally threaded said other opposite end portion of said elongated handle for securing said second implement to said other opposite end portion of said elongated handle.

6. The instrument of claim 1 wherein:

said other opposite end portion of said elongated handle is externally threaded; and said connecting portion of said second implement is internally threaded and threadably interfittable with the externally threaded said other opposite end portion of said elongated handle for securing said second implement to said other opposite end portion of said elongated handle.

7. The instrument of claim 1 wherein said elongated handle has an external surface and a gripping means defined on said external surface at two spaced apart locations disposed adjacent to said opposite end portions of said elongated handle.

8. The instrument of claim 1 wherein said working portion of said first implement is removably mounted on said connecting portion of said first implement such that said working portion of said first implement is replaceable.

* * * * *